United States Patent [19]

Wang et al.

[11] 4,274,272

[45] Jun. 23, 1981

[54] MECHANICAL DIGITAL LOCK

[76] Inventors: David T. Wang, Taipei; Sun-Tong De, Taichung, both of Taiwan

[21] Appl. No.: 944,786

[22] Filed: Sep. 22, 1978

[51] Int. Cl.[3] ..... E05B 37/16

[52] U.S. Cl. ..... 70/214; 70/299; 70/313

[58] Field of Search ..... 70/313, 214, 220, 287, 70/288, 297, 299

[56] References Cited

U.S. PATENT DOCUMENTS

| | | | |
|---|---|---|---|
| 3,009,346 | 11/1961 | Check | 70/214 |
| 3,277,679 | 10/1966 | Senowskis | 70/313 |
| 3,357,216 | 12/1967 | Cook | 70/313 |
| 3,903,718 | 9/1975 | Fish | 70/299 |
| 4,027,508 | 6/1977 | McGourty | 70/214 |

*Primary Examiner*—Robert L. Wolfe

*Attorney, Agent, or Firm*—Burns, Doane, Swecker & Mathis

[57] ABSTRACT

Mechanical digital lock operable through a series of mechanical operations actuated by the depression of digital keys comprises an intellectual combination of essential mechanisms including a plurality of keys, digital selectors, identifiers, locking means and automatic resets. The lock cannot be opened unless the predetermined digitals are sequentially depressed. Once the lock is opened, it is automatically reset. A change of combination of digitals can easily be manually effected without any tool. With its novel structure, it is highly reliable.

23 Claims, 15 Drawing Figures

MECHANICAL DIGITAL LOCK

FIELD OF INVENTION

The present invention relates generally to mechanical digital lock and more particularly to a mechanical digital lock that is operable through a series of mechanical operations actuated by the depression of digital keys, comprising an intellectual combination of essential mechanisms including a plurality of key means, digital selecting means, identifying means, locking means and automatic resetting means. The number of digital combination is enormous and the lock cannot be opened unless the predetermined digitals are sequentially depressed on the key board. Once the lock is opened, it is automatically reset. A change of combination of digitals can easily be effected manually without using of any tool. With its novel structure, it is highly reliable.

BACKGROUND OF INVENTION

Most traditional key-depression digital locks are of the electronic/mechanical type with complicated structure. Wiring is usually necessary upon installation and the costs of both manufacturing and installation are comparatively high. The lock will be dead during a circuit trouble or power failure, this being the main drawback. Some sorts of key-depression digital locks have been disclosed recently, however, their constructions are rather complicated with unusually high cost and comparatively low reliability. The change of digital combination can only be effected by a skilled worker with special tools. Besides, only four digits are usually adopted hence their number of combinations is quite limited.

SUMMARY OF INVENTION

Therefore, the main object of the present invention is to overcome the aforesaid drawbacks in conventional digital locks and to provide a new mechanical digital lock with novel design and high reliability, comprising digital selecting means having dial arm with changeable insertions which can be easily relocated to change digital combination. Besides, six up to ten digitals are capable of being adopted, so that the number of combination of digital becomes enormons. The lock digitals cannot be detected through hearing or touch-feeling.

Another object of the present invention is to provide a mechanical digital lock having mechanical means for identifying digital sequence. Key depression of a wrong sequence that is deviated from the predetermined order will result in a deadlock condition, until it is manually reset, the lock will not be opened.

Still another object of the present invention is to provide a mechanical digital lock having automatic resetting means which would effect automatically after the lock is opened. Lock can be reapplied without additional operation.

A further object of the present invention is to provide a mechanical digital lock having unique design of lock core and latch which is suitable both for use on doors of left and right swings.

A still further object of the present invention is to provide a mechanical digital lock with simple construction to enable easier manufacturing and installation, and especially suitable for use on any kind of door.

Other objects and features will become apparent from the following detailed descriptions to be taken in conjunction with the annexed drawings.

DETAIL DESCRIPTION OF PREFERRED EMBODIMENT

Figure 1:
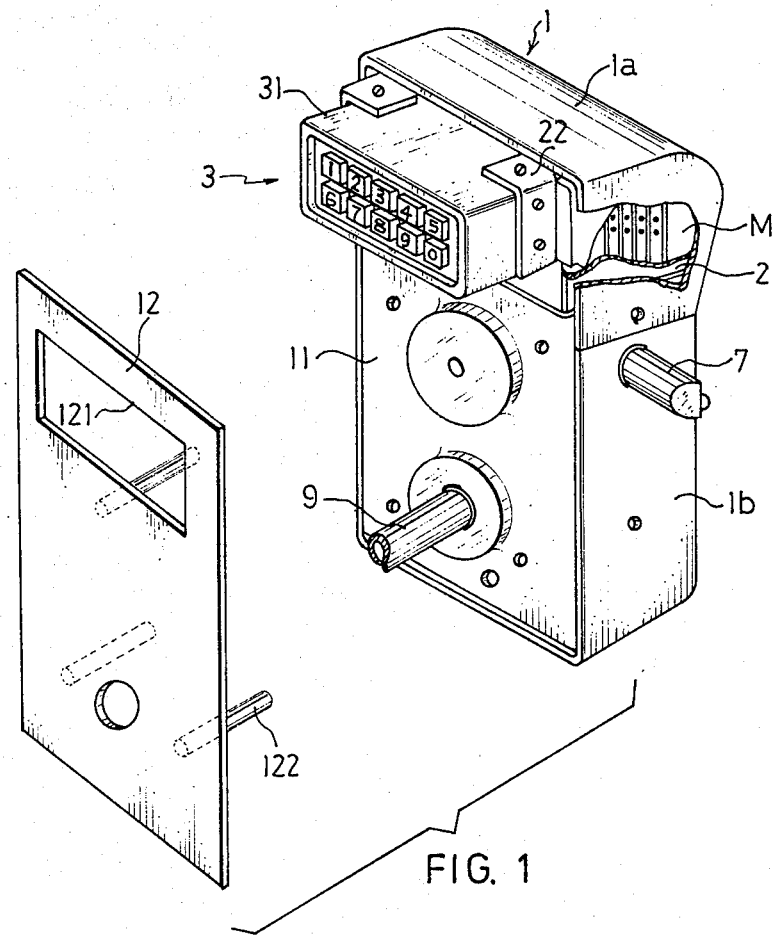
FIG. 1 is a partial cutaway perspective view of a preferred embodiment of the mechanical digital lock according to the present invention.
Figure 2:
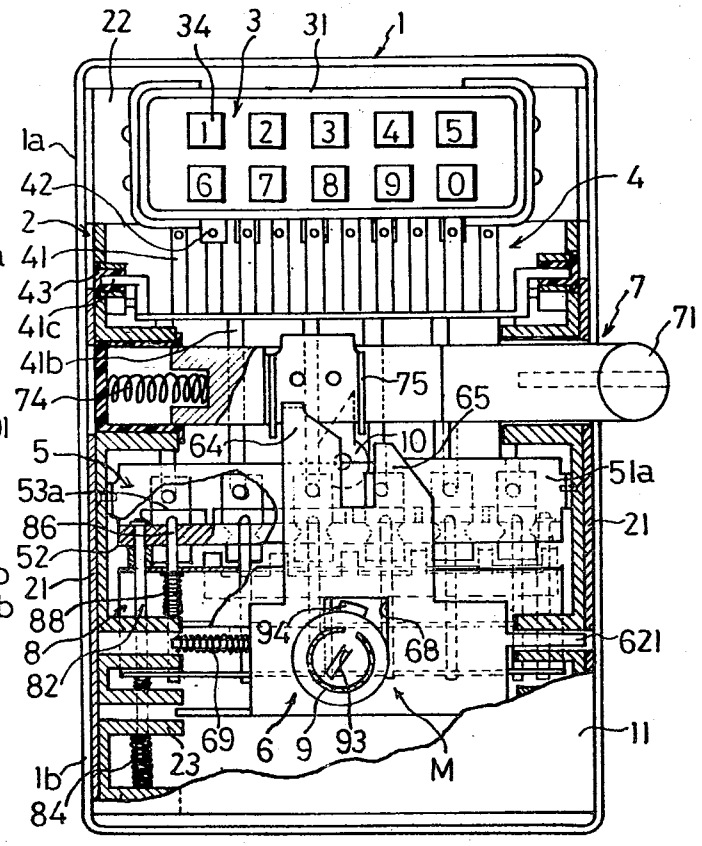
FIG. 2 is a partial cutaway front view of the same embodiment.
Figure 3:
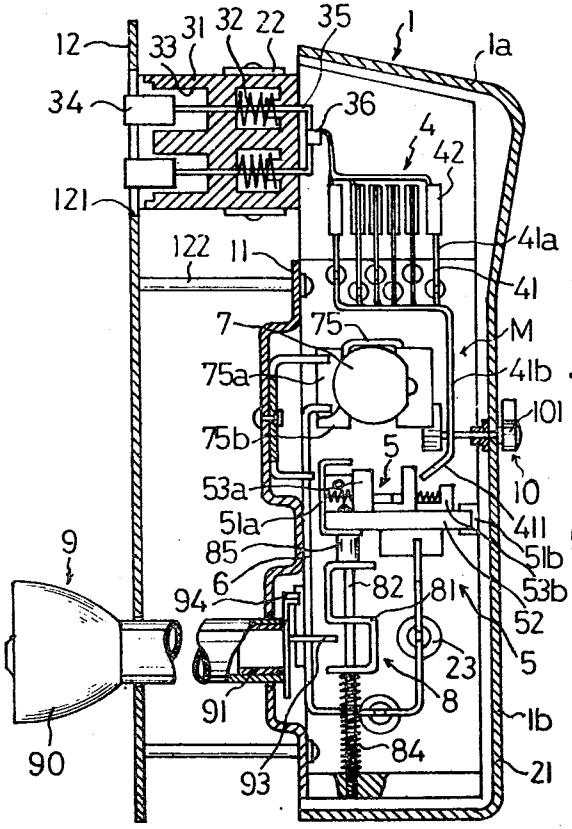
FIG. 3 is a partial cutaway side view of the same embodiment.

Now referring to FIGS. 1 to 3, the mechanical digital lock of the present invention comprises: an assembly of casing 1, frame 2, key means 3, digital selecting means 4, identifying means 5, core plate 6, latch means 7, resetting means 8, knob 9, inside opening means 10, base plate 11 and face plate 12.

The casing 1 is composed of an upper case 1*a* and a lower case 1*b*, and is detachably mounted by screws on the side walls of the base plate 11. The case encloses therein the whole mechanical means M of the lock. The upper case is detachably mounted upon the upper end of the lower case 1*b* with screws.

The frame 2 comprises a pair of side walls 21—21 and two connecting plates 22 to hold-tight a key panel box 31 with screws. Mechanical means M is mounted within the frame 2.

Figure 4:
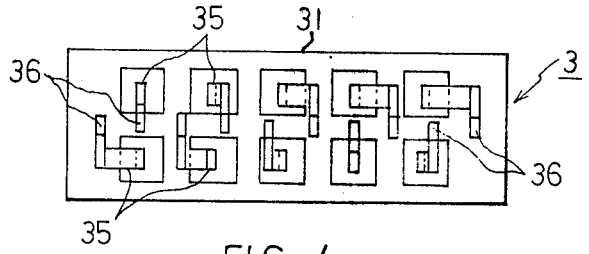
FIG. 4 is a back view of the key panel.

The key means 3 is mounted at the upper most section of the frame 2 on the connecting plate 22 thereof. The key means 3 comprises a key panel box 31, a plurality of keys 34, say ten in the present embodiment, representing usually numerals 0–9 and/or characters as required. The keys 34 are retained in key holes 33 provided in the key panel box 31 and each biased by a spring 32 from behind. Key rod 35 extendes from back to each key 34 into the case 1. For the compactness of the layout, the ten keys are arranged into two rows, five in the upper row and five in the lower row. Since it is necessary to arrange the end of key rods 35 into a single row to facilitate operation without confliction, the ends 36 of rods 35 are bent to such as shown in FIG. 4 to meet the purpose.

Digital selecting means 4 is disposed at a somewhat lower position than key means 3, comprising a number of sets of seleting arms 41 arranged parallely from front to rear, a number of set of arms chosen in this embodiment is six corresponding to predetermined number of digits, six. Hence each of the six inserts 42 is provided to be detachably and selectively inserted on the upper end of one arm of each set of arms 41.

Figure 5:
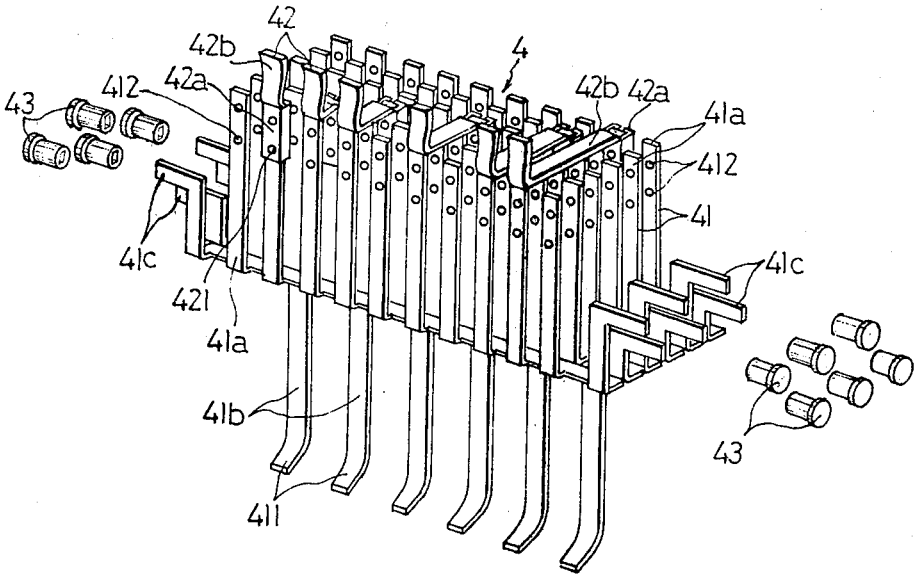
FIG. 5 is a perspective view of the digital selecting means thereof.

Each set of selecting arms 41, such as shown in FIG. 5 comprises a number of arms corresponding the number of the keys, in this case, ten. Each member of arm set 41 comprises an upwardly extended upper arm 41*a* and each set of arms 41 having a lower arm 41*b* extended from just one of the lower end of the ten arms 41 in the set. Since each lower arm, having forwardly bent tip 41*l* is extended from a different set of arms, to avoid their overlapping, each of the six sets of arms is consolidated to provide axle plates 41*c* at ends and with bearing socket 43 to be pivotally mounted on the side wall 21 of the frame 2, so that each set of arms can swing freely about the said axle. For the compactness of layout, the axles 41*c* are disposed at two different levels. In the meantime, to facilitate the lower tips 411 of downwardly extended lower arm 41*b* to be able to reach the identifying means which is prearranged in a single row, the upper/lower arms 41*a*/41*b* of the arm 41, except the left-hand one (the first one), are bent into different extent of the shape "ㄴ" with various length of horizontal spacing, so that the tips 411 can fall within a same plane where the identifying means is located.

Figure 6:
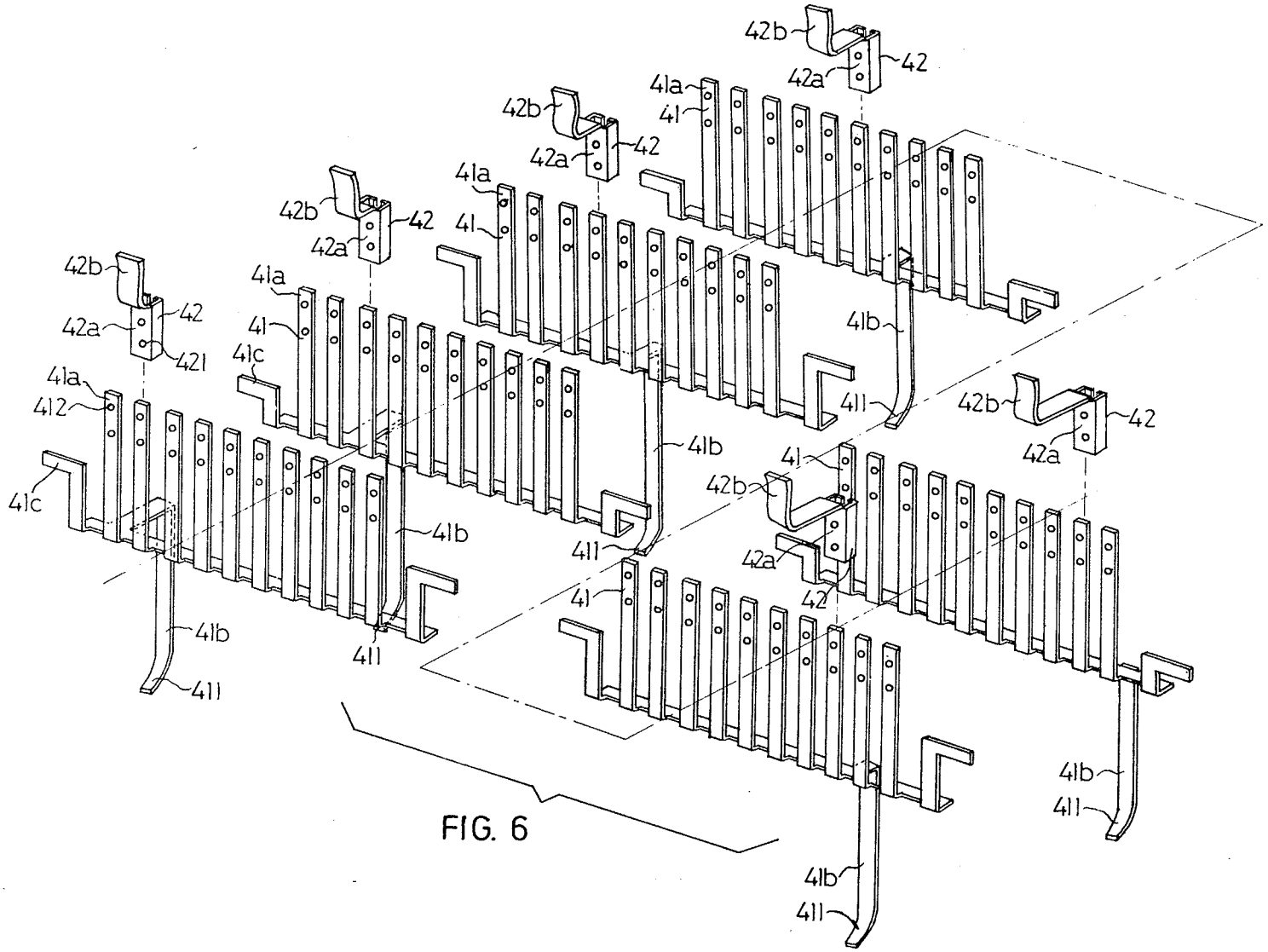
FIG. 6 is an exploded perspective view of the digital selecting arms.

Referring also to FIG. 6, it can be seen that each upper arm 41*a* of the ten arms in the set has one or two positioning hole 412 to facilitate the insertion of the inserts 42. The position of the inserts is set by projected nipples 421 provided inside the socket 42*a* of the inserts 42 to lock into the respective positioning holes 412. Each set of the six sets of selecting arms 41 is provided with one of such inserts 42. Upper arm 42*b* of the insert 42 is extended forwardly and is prepared to be touched by the end 36 of rod 35 of a depressed key. A gap is therefore maintained between the rod end 36 and the upper arm 42*b* of the insert 42. Since it is desired to let the upper arm 42*b* be in alignment with the single row rod ends 36, the bend of the upper arms 42*b* except the one closest to the key, into a "ㄴ" is necessary to meet the purpose, and the extent of the hands varies with increasing length of the horizontal portion from left to right. It is also necessary that the inserts 42 are so placed from the set closest to the key to the rearest set according to the predetermined order of digital numbers.

Figure 9:
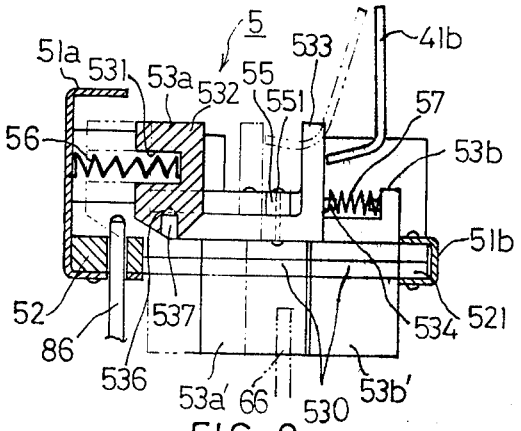
FIG. 9 is a partial cutaway side view of the digital identification means.
Figure 7:
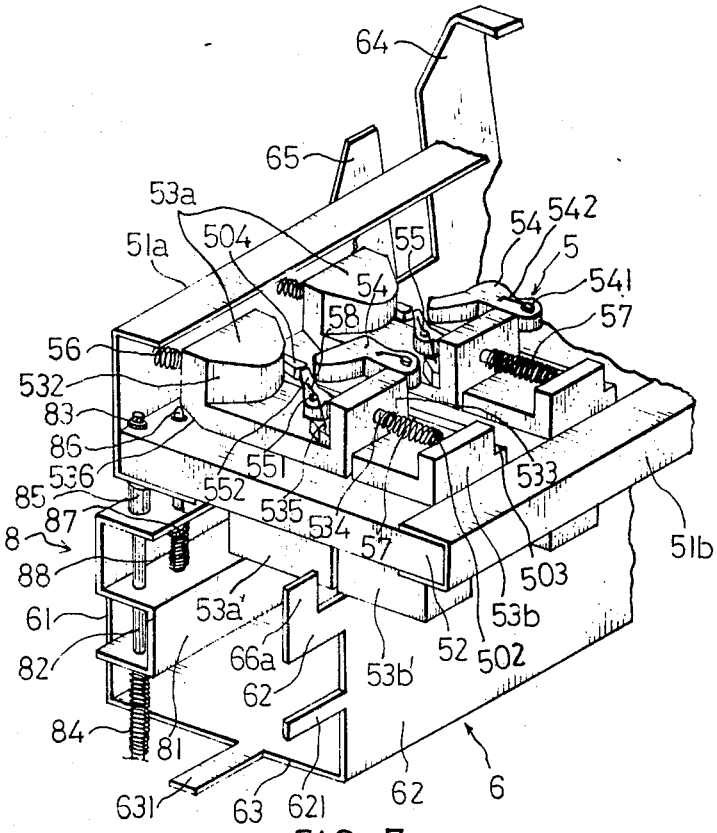
FIG. 7 is a perspective view of the digital identification means thereof.
Figure 8:
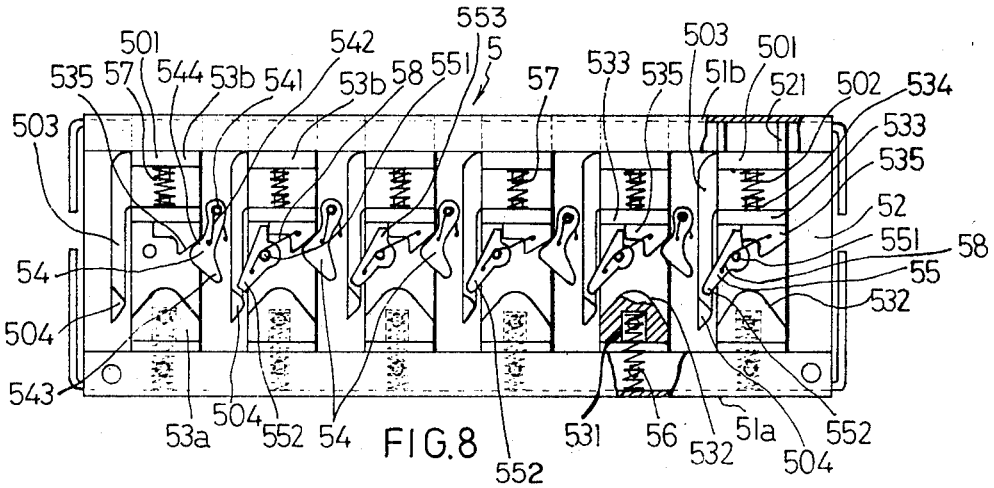
FIG. 8 is a top view of the digital idenification means.

The identifying means 5 is located under the selecting means 4, such as shown in FIGS. 7 to 9. It comprises a front fixing plate 51*a*, a rear fixing plate 51*b*, a guide plate 52 fixed between the two plates 51*a*, 51*b*. A plurality of sets (corresponding to the number of selecting arm sets) 41, i.e. six sets of elements each element comprising front sliding block 53*a* and rear sliding block 53*b* which blocks are slidably mounted in pairs on the guide plate 52. A claw 54 is pivotally disposed on plate 52 and between adjacent pairs of block 53*a*–53*b*. A stopper 55 is disposed on each front sliding block 53*a* except on the first or left-hand block 53*a*. A return spring 56 is provided between each front sliding block 53*a* and front fixing plate and a compression spring 57 is disposed between the front and rear sliding blocks 53*a*, 53*b* of each pair.

The front fixing plate 51*a* and the rear fixing plate 51*b* are both "U" shaped cross section, however, plate 51*a* is bigger than plate 51*b*, the guide plate 52 being clamped between them and fixed by screws. Guiding grooves 521 corresponding to the number of selecting arm sets 41, i.e. six, are evenly spaced on the guiding plate 52. The front and rear sliding block 53*a*, 53*b* are slidably mounted in pairs on the plate 52 with their sliding channel formed on individual gates or legs 53*a*′ and 53*b*′ inserted into the guiding groove 521. A recess 531 is formed in the front wall of the front sliding block 53*a*, a spring 56 with its one end retained in said recess 531 and the other end pushed against the front fixing plate 51*a*. Upon each front sliding block 53*a*, disposed in front is a wedge like projection 532 which is opposite to a straight rear wall 533. At the back of said rear wall 533, a spring retaining stud 534 is provided. While on the front side of the wall 533, a hook like projection 535 is disposed. Between projections 532 and 535, a stopper 55 is mounted with a pivot pin 551. Biased by the force of spring 58, the front end 552 of the stopper 55 tends to rotate toward the left, yet the rear end 553 of the stopper 52 falls against the side surface of the projection 535 to ensure a limited projection of the front end 552. An inclined surface 536 is formed in front of the leg 53*a*′ of the front sliding block 53*a*. At the bottom of the inclination, a locking recess 537 is drilled thereunder.

The rear sliding block 53*b* has a rear wall 501. A spring retaining stud 502 is disposed on the inner side to be opposite the stud 534 on front slinding block 53*a*. A compression spring 57 is retained between said studs 502–534. An arm 503 extends forwardly from the side of the rear sliding block 53*b*. A triangular shaped stopper 504 is formed at the tip of the arm 503 to be almost in contact with the projected end 552 of the stopper 55.

The hook shaped claw 54 is pivoted through a pin 541 to the guide plate 2 at a position between adjacent grooves 521, and biased by a spring 542 to force its claw end 543 to have its back inclination 544 pressed constantly against the inclination on projection 535. The front end 543 of the claw 54 keeps an appropriate gap with the front end 552 of the stopper 55.

Figure 10:
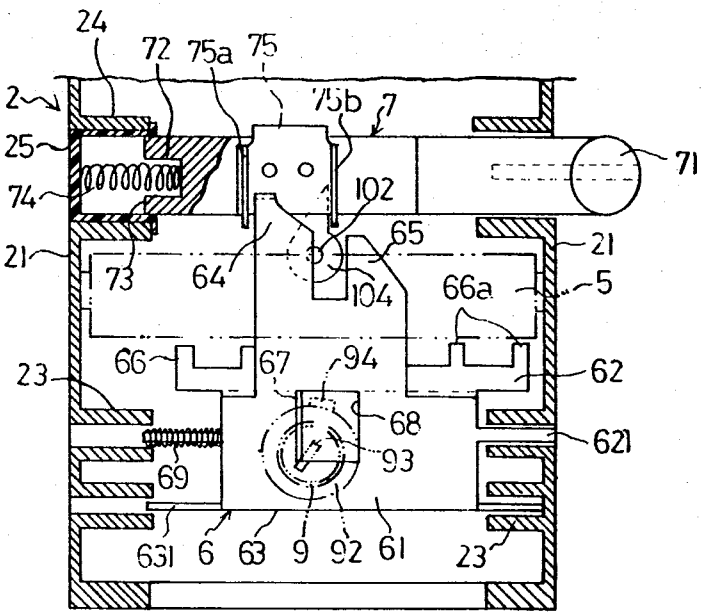
FIG. 10 is a partial cutaway front view showing the relation between the core plate and the latch means.
Figure 11:
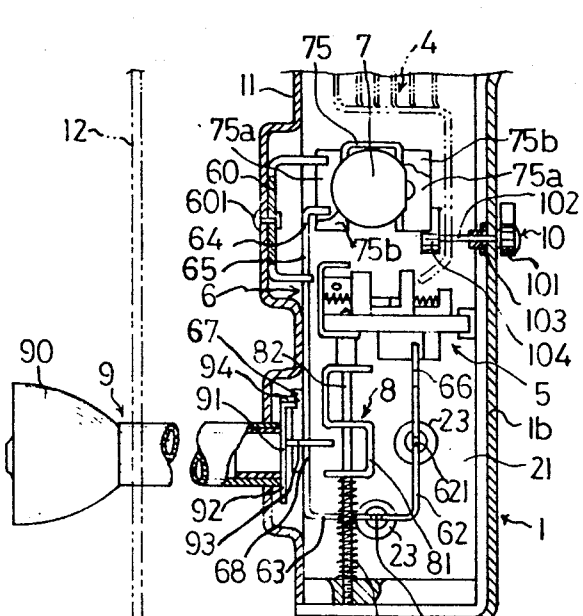
FIG. 11 is a partial cutaway side view showing the relation between the core plate and the latch means.

Lock core plate member 6 having a side cross section of "L" is disposed under the identifying means 5, such as shown in FIGS. 10, 11. The core plate member 6 comprises a front plate 61, a back plate 62 and a bottom plate 63. On the front plate 61, one each long and short claw 64, 65 are formed. A toothed portion 66 having a plurality of teeth is formed on the back plate 62, in a position under the blocks 53*a*, 53*b*, with the projected teeth just engaging into a continuous groove 59 formed between the legs 53*a*′, 53*b*′ of the blocks 53*a*, 53*b*. A rectangular apurture 68 with a vertical flap 67 punched out along one side is disposed at the center of the front plate 61 of the core plate 6. A pair of arms 621, 631 extended from both sides of the back plate 62 and the bottom plate 63, respectively to be slidably inserted into pairs of guides 23 provided on side walls 21 of the frame 2 for the supporting of core plate 6. A returning spring 69 is provided on the left arm 621 to bias the core plate against the right side wall 21. A revolving arm 60 is pivoted to a pin 601 on the inner center of the base plate 11, with its upper and lower end engaged respectively to the latch 7 and the short claw 65 to provide for the door opening.

Latch means 7 is provided laterally across the central part of the frame 2 and located between the selecting means 4 and the identifying means 5. Latch 7 with its one end formed into a wedge head 71 and the other base end 73 having a central recess 72 is slidably mounted into a pair of horizontal guides 24 formed on the two side walls 21 of the frame 2. The base end 73 of the latch 7 is slipped into a closed end nylon socket 25 inserted in one of the horizontal guides 24, a spring 74 is retained between the socket 25 and the central recess 72 to bias the latch to cause its wedge head to project out of the side wall 21. A follower member 75 having a left plate 75*a* and a right plate 75*b* is detachably clamped to the middle of the latch 7. The bent end of the long claw 64 extends at the right side of the left follower plate 75*a*, so that when the core plate 6 moves leftward, claw 64 will pull the follower member 75 leftward against the spring 74 to cause the retreat of the wedge head 71 of the latch 7 into the frame 2 to open the door. The core plate 6 thus functions as a latch actuating member.

Figure 12:
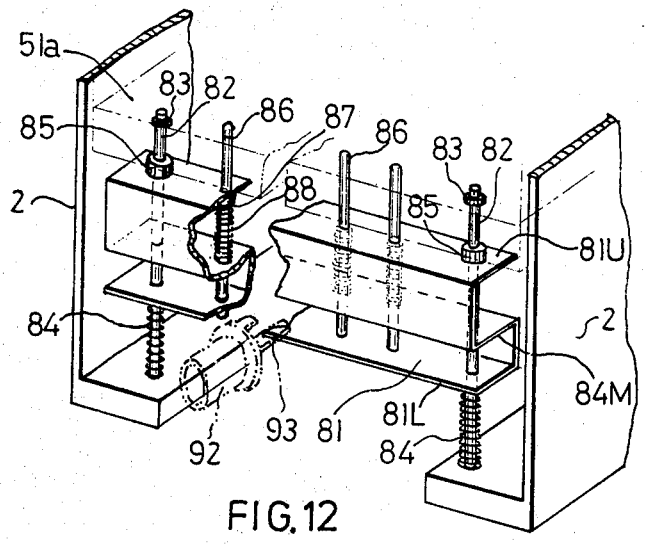
FIG. 12 is a partial cutaway perspective view showing the essential part of the resetting means.

The resetting means is located under the identifying means 5 and in parallel with the core plate 6 such as shown in FIG. 12. It comprises a supporting rack 81 having a "S" shaped cross section. The rack 81 with its two ends passed through two vertical posts 82 and being movable up-down freely thereon. The lower end of each post 82 is fixed at the lower part of the frame 2 while its upper end passes through the bottom of the guide plate 52 and is limited by a snap ring 83. A spring 84 is provided at lower end of said post 82 in a position between the supporting rack 81 and the frame 2 to bias the said rack upward. A spacing sleeve is disposed on the post 82 between the guide plate 52 and the rack 81 to keep a constant distance therebetween. On the said rack 81, a plurality of retaining or locking pins 86 corresponding to the position of the front sliding block 53*a* are disposed to have their upper ends passed through the guide plate 52 and projected thereabove under the front inclination 536 of the block 53*a*, while their lower ends are allowed to stick out under the lower deck 81L of the rack 81 to a certain extent. A snap ring 87 is provided at the middle section of the locking pin 86 and just under the upper deck 81U of the rack 81. Between the snap ring 87 and the middle deck 81M of the rack 81, a spring 88 is provided to bias upward the pin 86. When the front sliding block 53*a* moves forward, the pin 86 will fall within the recess 537 and return the said block in position.

A knob means 9 is provided at center front of the frame 2, with a knob handle 90 disposed out of the face plate 12, and socket sleeve 91 extending inwardly through the face plate 12, base plate 11 to reach the coreplate 6. A flange 92 is formed at the inner end, from the center of the flange, a reset actuating plate 93 is further extended through the aperture 68 to reach upon the lower deck 81L of the supporting rack 8. A core actuating plate 94 is bent from the upper edge of the flange 92 to engage with the vertical flap 67. When the knob 9 is turned counterclockwisely, the core actuating plate 94 engages the flap 67 to force the core plate moving leftward to open the lock. When the knob is turned clockwisely, the reset actuating plate 93 forces the rack 8 to move downwardly to accomplish manual reset.

The inside opening means 10 is provided at the center of the lower case 1*b*. It comprises a turning knob 101 having a shaft 102 retained by a bearing 103 fixed to the lower case 1*b* and passed into the frame 2. A cam 104 is provided at the end of the shaft 102 to engage with the right plate 75*b* of the follower member 75. When the knob 101 is turned, the cam 104 actuates the follower 75 to open the door directly from inside without the aid of the core plate 6. The base plate 11 as shown serves for connecting the face plate 12 from outside as well as the whole frame 2, and for fastening onto the inner wall of the door. The face plate 12 is a metal cover to be connected with the knob 90. A rectangular opening 121 is provided to facilitate the display of the key panel 34 of the key panel box 3. Three hollow posts stick out from within to facilitate bolts extending from the base plate 11 to pass through and fasten thereon. The variation in door thickness can be accommodated through the adjustment of the thread length of the bolt in concern.

The above description describes the construction of the present invention, and now that the application and the function are to be related.

Figure 13:
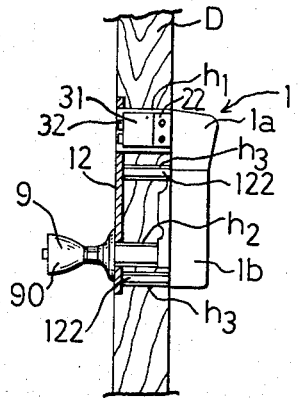
FIG. 13 is a schematic view showing the installation of the lock in concern.

FIG. 13 shows the way for installing the lock. According to the template furnished by the manufacturer, a rectangular opening $h_1$, a round opening $h_2$ and three bolt holes $h_3$ are opened on the door. The face plate 12 is installed from outside of the door with three threaded posts 122 thereon to pass through the door thickness D. Then the base plate 11 is installed from inside. Let the socket sleeve 91 be aligned with the knob 90, and thrust both to fit. A little turning is helpful to enable the groove provided on the sleeve 91 to be matched exactly with a projection provided inside the knob base. Pass the three bolts from inside the base plate 11, through the corresponding bolt holes formed on the base plate 11, and fasten the bolts into three threaded post 122 of the face plate 12, so that the base plate 11 is fitted tightly against the face plate 12 with the door thickness inbetween. The fixation of the base plate 11 on the door D is further reinforced by four piece of wood screws. The pre-assembled frame including key panel box, selecting means, identifying means, resetting means, latch means, core plate etc. is inserted from above so that the latch enters into the side wall opening on the base plate 11. The whole frame is forced in with hands and door knob 9 is turned a little to enable the flap 67 on the core plate 6 to be close to the core plate actuating plate 94 on the socket sleeve 91 of the knob 9. Both sides of the frame 2 are hence enclosed in the side walls of the base plate 11. Fasten three screws on both sides, so that the frame 2 and the base plate 11 are tightly connected. Put on the case 1 and again fasten with screws to the side walls of the base plate 11. By then the installation of the lock is finished. Exposed outside the door are the knob 9 and key panel 31. Wedge head 71 of the latch sticks out at the side of door D into a latch pit (not shown) provided on the door sash. When the combination numbers are not depressed in a proper way and the knob 9 is turned left, since the core plate 6 is in locked condition, teeth 66 are hampered by the legs 53*a'* of sliding blocks 52*a*. Even though the core plate actuating plate 94 is in contact with the flap 67 and tending to force the core plate 6 toward left, the latch 7 cannot be moved and the door D cannot be opened.

Figure 14A:
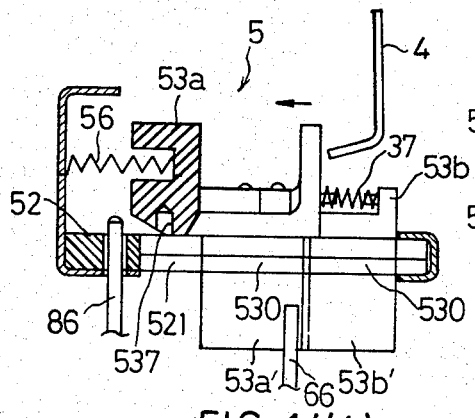
FIG. 14 (A) and (B) are side views showing the operation of the lock in concern.
Figure 14B:
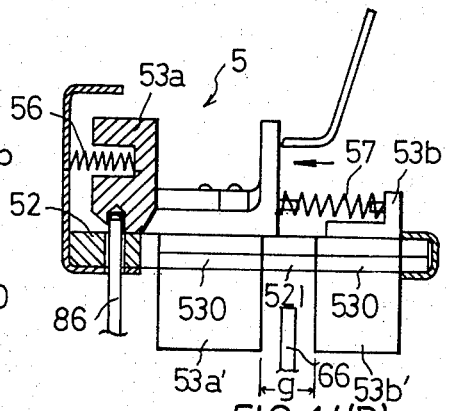

Now referring to FIG. 14 (A) and (B), if the keys 34 are depressed in a predetermined sequence, the key rods 35 in turn push the corresponding inserts 42 of the selecting arm set 41, then the lower arm tip 41*b* swings about the axle center 41*c* and presses the rear wall 533 of the front sliding block 53*a*, forcing the block 53*a* to slide forward along the guide groove 521. Since the first or left-hand block 53*a* is not provided with a stopper 55, this very block 53*a* is free to move independently forward from a rest mode (FIG. 14A) without bothering the rear sliding block 53*b*. A gap "g" is then created between legs 53*a'*–53*b'* of block 53*a*, 53*b* to admit passage of the teeth 66 of the core plate 6. When the first front sliding block 53*a* reaches a position where the locking recess 537 there under is aligned with the locking pin 86, the pin 86 is forced by the spring 88 into the recess 537 thereby anchoring the block 53*a*, so that when the key is released from the depression, the block 53*a* stays without returning by the spring 56, the gap g is thus reserved for the passing of teeth 66 of the core plate 6.

When the first front sliding block 53*a* moves forward, inclination of projection 535 forces the claw 54 to move about the pivot 541 toward right or the second front sliding block 53*a*. The front end 543 of the claw 54 pushes the stopper 55 on the second front block 53*a* toward the right, until said front end 543 falls against the side wall of the second front block 53*a* and forces the front end 552 of the stopper 55 retreating entirely. By then the front end 552 of the stopper 55 releases the stopper 504 of the arm 503 extended from the rear sliding block 53*b*. Thus, the claw 54 deactivates the stoppers 55. Therefore when the second digit of the combination is depressed on the key panel 34, corresponding selecting arm set 41 would repeat the function as aforementioned. Its lower arm 41*b* pushes forward the second front block 53*a* to move ahead independently and also leaves a gap "g" between legs 53*a*'–53*b*' of the second set blocks 53*a*, 53*b* to let go of the teeth 66 of the core plate 6. This process repeats until all the six (or more) predetermined digits are depressed on the key panel. Six gaps "g" thus formed allow the free pass of the teeth 66 of the core plate 6, so that when the knob 9 is turned left to open the lock, latch 9 is forced toward left by the actuating plate 94 through flap 67 (see FIG. 10), and the long claw 64 on the core plate 6 in turn pushes latch 7 toward left against the spring 74, wedge head 71 of the latch 7 thus retreats into the case 1, the lock is opened.

The identifying means 5 according to the present invention serves to automatically lock up when the key is depressed in error or in a wrong sequence. Move particularly, the multi-sets of front/rear sliding blocks have to be operated in a sequence from first, second, third . . . to the last. A wrong depression of depressions following a wrong digital sequence, such as to depress a second digit instead of first, the front sliding block corresponding to the key pushed, i.e. the second front block is moved forward along the guide groove 521. Since the preceeding or the first digital number was not depressed in the first place, the first front block has not been moved forward, and the first claw 54 stayed unmoved, the second front block or the front block of the wrongly depressed digit number still keeps its stopper 55 from releasing the stopper 504 of arm 503 extended from the rear block 53*b*. The forward movement of the second front block 53*a* would move the rear block 53*b* in the same time. No gap "g" will create between legs 53*a*'–53*b*' of blocks 53*a*, 53*b*. Even if an attempt is made later on to depress a series of digits in a right sequence, since the above fault has already blocked up the expected gap "g", the continuation of gaps "g" is broken and would not let the core plate 6 get through. The block-up of the gap "g" would occur as many times as the key is wrongly depressed.

When the lock is opened, all the blocks 53*a* remain unreleased by the pins 86. After turning the knob 9 in a counter-clockwise direction, the resetting actuating plate 93 presses down the rack 81 of resetting means 8, pins 86 in turn release the front sliding blocks 53*a* to move backward. By then a part of the teeth 66 are still retained between the front blocks and rear blocks, the front blocks although have already been released by the pins 86, yet have not resumed their original positions. When the knob 9 is turned to its dead end, the latch 7 retreats fully into the case 1 and the door is opened. By releasing the knob 9, the core plate 6 biased by the spring 69 restores its original position, pins 86 stick out just like in the original condition, and the front blocks biased by the spring 56 resume their original position. The resetting of the lock is thus accomplished. The latch 7 again projects out of the case, and automatically locks up the door. In case it is suspicious whether the keys have been depressed by any party before the intented depression, a clockwise turning of the knob before starting depression, produces downward action of the resetting actuating plate 93, whereby the rack 81 is lowered to force down the pins 86, so that resetting can also be achieved.

If it is desired to open the lock from within, turn the knob 101 clockwisely, the cam 104 in turn moves the follower 75 of the latch 7 without bothering the core plate 6 and the identifying means 5 and retreats the latch 7 directly to open the door. By releasing of the knob 101, the latch 7 biased by the spring 74 resumes its position, and the knob 101 restores also through the reaction of follower 75 and cam 104.

The abovesaid illustration refers to a door with lock mounted on the right side as viewed from outside. The lock of the present invention is also capable of being installed to the left side of the door. The alternation can be easily effected by reverse the latch 7 with the nylon socket 25 replaced at the other end. In other words, to put the wedge head of the latch to the left and the base end 73 to the right and let the socket 25 be covered at the base end 73. The follower member is to be relocated reversely which can be done readily by the manufacturer or otherwise.

The lock opening operation then becomes to be like follows: the knob is still to be turned counterclockwisely, the core plate moves to left accordingly. Since the follower member 75A is reversely relocated, no more plate on the follower member 75A is to be moved by the long claw 64, only the upper end of the revolving arm 60 is to engage with the right side of the plate 75*b*. Hence the short claw 65 forces the lower end of arm 60 to move left, and arm 60 rotates about the center 601 to cause its upper end moving right, and pushes the latch 7 toward right through plate 75*b*. The latch 7 retreats to open the lock. The said revolving arm 60 was inactive in the right-mounted lock, since it did not engage with either of the plates 75*a*, 75*b*.

Combination change can be effected manually by changing the positions of inserts 42. Open upper case 1*a*, take down all the old inserts, then relocated according to a new desired digital number, the inserts are to be placed on one of the upper arm 41*a* of each set of ten, the location of the inserts in the sets corresponding to the number sequence to be depressed on the key panel. Upper end 41*a* of the arm sets 41 can be marked with 0–9, for the convenience of recognition.

Feeling by touching may be attempted by a potential burglar to find out which number is active. Thus, false inserts 42 may be mounted to each of the blank upper end 41*a* of the inactive numbers, so that every push of key 34 would get the same touching feeling, since behind rod 35 of every key there is an insert 42. However, even without the false inserts, the combination of six out of ten keys is already complicated enough for a burglar to try out.

The above featured lock gives an enormous number of combinations. Safety is reassured through the provision of selecting, identifying means as well as the automatic resetting means. Construction is relatively simpler than the others made in likewise category, less trouble and easier to be manufactured, and the combination can be easily changed without a special tool. Since no conventional key is provided, there would be no fear of losing of the same.

The above embodiment serves only for illustration purpose and not by way of limitation, modifications will become evident to those skilled in the art which will fall within the scope of attached claims.

We claim:

1. A mechanical digital lock for use on a door which opens and closes within a frame, said lock comprising:
- a casing mountable on the door,
- latch means carried by said casing and movable into and from locking engagement with the door frame,
- manually actuable handle means carried by said casing and accessible externally of the casing,
- latch actuating means displaceably carried by said casing and operably connected to said handle means and said latch means so as to be displaced in response to actuation of said handle means to move said latch means into and from said locking engagement;
- a plurality of key means carried by said casing, each key means including a manually displaceable key accessible externally of said casing,
- a plurality of selecting means carried by said casing and each arranged to be engaged and displaced by an associated one of said key means when the key thereof is displaced,
- identifying means carried by said casing and actuable by said selecting means to permit displacement of said latch actuating means for moving said latch from said locking position, said identifying means comprising:
  - a plurality of independently movable elements arranged to be engaged and moved to a release mode by an associated one of said selecting means when the latter is displaced by its associated key means,
  - each element including gate means arranged to prevent displacement of said latch actuating means to unlock said latch means unless said element is in its release mode;
  - all of said elements, except an initially actuable one of said elements, including stop means normally preventing movement to said release mode,
  - all of said elements, except a finally actuable one of said elements, including stop-deactivating means response to movement of said element to its release mode for deactivating the stop means of the subsequent element to permit the latter to move to its release mode, so that all of said elements can be moved to the release mode only when actuated in proper sequence,
- retaining means carried by said casing for releasably holding each of said elements in a release mode, and
- resetting means carried by said casing and operably connected to said handle means and retaining means to release said retaining means when said handle means is moved to lock said latch for enabling said elements to move out of said release mode.

2. Apparatus according to claim 1, wherein said elements each comprise first and second slidable blocks, said first block being engageable by an associated one of said selecting means, said stop means normally connecting said second block for movement with said first block and being moved to a deactivated position by said stop deactivating means of a previous by-actuated element to enable said first block to be displaced relative to said second block to define said release mode for such element.

3. Apparatus according to claim 2, wherein said second block when displaced together with said first block is positioned to prevent displacement of said latch actuating means to unlock said latch.

4. Apparatus according to claim 2, wherein said retaining means holds said first block and said second block when the latter is displaced together with said first block.

5. Apparatus according to claim 1, wherein each key means includes a key rod extending from the back of an associated key.

6. Apparatus according to claim 5, wherein said selecting means comprises a plurality of sets of selecting arms, the number of arms of each set corresponding in quantity to said keys; the number of sets of arms corresponding in quantity to said elements, one selecting arm of each set being arranged to be contacted by one of said key rods.

7. Apparatus according to claim 6, wherein a removable insert is mounted on an upper end of each of said one arms, said insert being removable and positionable upon each arm of its associated set, said inserts being arranged to be contacted by said key rods.

8. Apparatus according to claim 7, wherein said sets of arms are arranged parallel, one behind the other, each insert including a horizontally extending portion, the forward ends of said horizontally extending portions lying on a common vertical plane.

9. Apparatus according to claim 7, wherein the arms of each set are interconnected and mounted for common pivotal movement; each set of arms including a single downwardly depending arm portion which is engageable with an associated one of said elements.

10. Apparatus according to claim 9, wherein said lower arm portions are arranged in a common plane.

11. Apparatus according to claim 2, wherein said identifying means is disposed beneath said selecting means and includes a guide plate carrying a plurality of guide grooves, said elements being slidable in said grooves.

12. Apparatus according to claim 11, wherein said stop means is mounted on said first block, said second block including a stop arm normally engageable by said stop means; said stop-deactivating means comprising a plurality of claws pivotally mounted on said guide plate between adjacent elements, said claw being engageable by the first block of a previously actuated element and swingable thereby into engagement with said stop means of a subsequently actuable element to disengage such stop means from its associated stop arm to enable said first block of said subsequently actuable element to be displaced relative to the second block thereof by its associated selecting means.

13. Apparatus according to claim 12, wherein said first block includes upstanding front and rear walls; said front wall including a front surface having a recess; said rear wall including a front surface having a forwardly facing projection, and a rear surface having a rearwardly facing spring retaining stud; a front spring disposed in said recess for urging said first block toward said second block, and a second spring mounted on said retaining stud and disposed between said first and second blocks.

14. Apparatus according to claim 13, wherein said stop means is mounted on said first block between said front and rear walls and mounted for swinging movement about a vertical axis; a third spring normally biasing said stop means to a position wherein one end thereof abuts against said projection, and the other end thereof projects beyond a side of said first block.

15. Apparatus according to claim 12, wherein said first sliding block includes a bottom surface which is inclined at its front end and includes a vertical locking recess for receiving said retaining means.

16. Apparatus according to claim 13, wherein said second block includes an upright rear wall, a spring retaining stud disposed on a front surface of said last-named rear wall in alignment with said spring retaining stud on said first block; said second spring retained on said studs; said stop means including a stop arm extending forwardly from one side of said second block and extending alongside said first block; said stop means further comprising a triangular stop member normally positioned to acontact said stop arm.

17. Apparatus according to claim 16, wherein each of said claws is of hook-shape and is pivotally mounted on said guide plate and biased by a fourth spring whereby one portion thereof engages said projection on said first block, and another portion thereof is spaced from said stop member of a subsequent element.

18. Apparatus according to claim 17, wherein displacement of said first block forwardly along its associated guide groove causes said stop member thereof to engage said stop arm of said second block to displace the second block along with the front block; said projection on said first block camming its associated claw such that said other portion of the latter swings toward the subsequent element to contact the stop member thereof and swing the latter inwardly to a position permitting relative movement between the first and second blocks of said subsequent element.

19. Apparatus according to claim 15, wherein said retaining means includes a plurality of upwardly biased locking pins arranged to enter said locking recess of an associated one of said first blocks upon the latter being pushed forwardly.

20. Apparatus according to claim 1, wherein said latch actuating means includes a core plate disposed beneath said identifying means and arranged for horizontal sliding movement, said core plate including a first portion engageable with said latch means for moving said latch, and a second portion disposed beneath said elements and arranged to pass through gaps formed by said elements in their release modes.

21. Apparatus according to claim 20, wherein said latch is positioned for horizontal movement above said core plate and is disposed vertically between said selecting means and said identifying means.

22. Apparatus according to claim 1, wherein said resetting means comprises an S-shaped horizontal supporting rack mounted for vertical movement; spring means biasing said rack upwardly; said retaining means comprising a plurality of vertical locking pins biased upwardly such that upward ends thereof are disposed in the path of travel of said elements and are receivable within recesses of said elements to retain said elements in the release modes of the latter; said handle means including a reset actuating member which engages said rack when said latch is being closed, to push said rack downwardly such that said rack displaces said locking pins downwardly from engagement with said elements.

23. A mechanical digital lock for use on a door which opens and closes within a frame, said lock comprising:

a casing mountable on the door, latch means carried by said casing and movable into and from locking engagement with the door frame, manually actuable handle means carried by said casing and accessible externally of the casing, latch actuating means displaceably carried by said casing and operably connected to said handle means and said latch means so as to be displaced in response to actuation of said handle means to move said latch means into and from said locking engagement, a plurality of key means carried by said casing, each key means including a manually displaceable key accessible externally of said casing, a plurality of selecting means carried by said casing and each arranged to be engaged and displaced by an associated one of said key means when the key thereof is displaced, each selecting means comprising:

a plurality of sets of selecting arms, the number of sets of arms corresponding in quantity to the number of digits in the lock combination, and a removable insert disposed upon one selecting arm of each set and arranged to be engaged by one of said key means, identifying means carried by said casing and actuable by said selecting means to permit displacement of said latch actuating means for moving said latch from said locking position, said identifying means comprising:

a plurality of independently movable elements arranged to be engaged and moved to a release mode by an associated one of said selecting means when the latter is displaced by its associated key means, each element including gate means arranged to prevent displacement of said latch actuating means to unlock said latch means unless said element is in its release mode, retaining means carried by said casing for releasably holding each of said elements in a release mode, and resetting means carried by said casing and operably connected to said handle means and retaining means to release said retaining means when said handle means is moved to lock said latch.

* * * * *

UNITED STATES PATENT AND TRADEMARK OFFICE

CERTIFICATE OF CORRECTION

PATENT NO. : 4,274,272

DATED : June 23, 1981

INVENTOR(S) : David T. Wang, and Sun-Tong De

It is certified that error appears in the above—identified patent and that said Letters Patent is hereby corrected as shown below:

Correction of co-inventor's name:

Line item [76] "Inventors: David T. Wang, Taipei; Sun-Tong De, Taichung, both of Taiwan"

should read -- Inventors: David T. Wang, Taipei, San-Tong Day, Taichung, both of Taiwan --.

Signed and Sealed this

*Sixth* Day of *October 1981*

[SEAL]

*Attest:*

GERALD J. MOSSINGHOFF

*Attesting Officer*

*Commissioner of Patents and Trademarks*